US007030826B2

(12) United States Patent
Scorer

(10) Patent No.: US 7,030,826 B2
(45) Date of Patent: Apr. 18, 2006

(54) MICROWAVE TRANSITION PLATE FOR ANTENNAS WITH A RADIATING SLOT FACE

(75) Inventor: Michael Scorer, Hertfordshire (GB)

(73) Assignee: Smiths Group Plc, London (GB)

( * ) Notice: Subject to any disclaimer, the term of this patent is extended or adjusted under 35 U.S.C. 154(b) by 0 days.

(21) Appl. No.: 10/765,074

(22) Filed: Jan. 28, 2004

(65) Prior Publication Data

US 2004/0183620 A1 Sep. 23, 2004

(30) Foreign Application Priority Data

Feb. 5, 2003 (GB) ..... 0302584

(51) Int. Cl.
*H01Q 13/22* (2006.01)
*H01P 5/103* (2006.01)

(52) U.S. Cl. ..... 343/771; 333/26

(58) Field of Classification Search ..... 333/26, 333/34; 343/771
See application file for complete search history.

(56) References Cited

U.S. PATENT DOCUMENTS 3,725,824 A 4/1973 McDonald
5,148,131 A 9/1992 Amboss et al.
5,359,339 A * 10/1994 Agrawal et al. ..... 343/786
6,201,453 B1 * 3/2001 Chan et al. ..... 333/26
6,363,605 B1 * 4/2002 Shih et al. ..... 29/600
6,577,206 B1 * 6/2003 Ikeda ..... 333/26

FOREIGN PATENT DOCUMENTS

FR 2432775 * 4/1980 ..... 333/26
JP 132203 * 5/1989 ..... 333/26

OTHER PUBLICATIONS

Search Report for GB0400287.9, Jun. 1, 2004.

* cited by examiner

*Primary Examiner*—Benny Lee
(74) *Attorney, Agent, or Firm*—Connolly Bove Lodge & Hutz LLP; Larry J. Hume

(57) ABSTRACT

A microwave antenna has a rectangular section waveguide with two narrow walls and and two broad walls. Towards one end, the waveguide is coupled with a microwave transition by which a coaxial connector can be coupled to the waveguide. The transition has a conductor extending through a narrow wall and connected internally with a transition plate. The transition plate extends longitudinally, centrally along the waveguide and is stepped to provide a quarter wave section.

12 Claims, 3 Drawing Sheets

MICROWAVE TRANSITION PLATE FOR ANTENNAS WITH A RADIATING SLOT FACE

BACKGROUND OF THE INVENTION

This invention relates to microwave transitions and antennas.

The invention is more particularly concerned with transitions between a coaxial connection and a sidewall of a waveguide, such as in an antenna.

Waveguides, such as for radar antennas, generally have a rectangular section and connection is usually made to the broader side wall or to the end wall of the waveguide by a coaxial connection. Such arrangements present no particular difficulties in producing a good performance and wide bandwidth. It can, however, be advantageous in some circumstances to make a connection to the narrow wall, such as in order to produce a compact configuration. If a connection is made to the narrow wall it usually produces a poor performance and narrow bandwidth.

SUMMARY OF THE INVENTION

It is an object of the present invention to provide alternative microwave transitions and antennas.

According to one aspect of the present invention there is provided a microwave transition including a waveguide of rectangular section having a narrow wall and a broad wall, and a first conductor extending through the narrow wall of the waveguide and attached with a transition plate at its internal end, the plate being aligned centrally of the waveguide and extending lengthwise in contact with an internal surface of the broad wall, and the height of the transition plate being greater adjacent the conductor than away from the conductor.

The transition plate is preferably stepped to a reduced height away from the conductor and may provide a quarter wave section. Alternatively, the plate may taper to a reduced height away from the first conductor. A cylindrical outer conductor may extend around a part of the length of the first conductor. The transition may include a dielectric member located between the first conductor and the outer conductor. The first conductor may comprise two parts arranged axially of one another, a dielectric material being supported between the two parts of the first conductor in a hole in the narrow wall. The first conductor may have a portion extending parallel to the narrow wall.

According to another aspect of the present invention there is provided a microwave antenna including a transition according to the above one aspect of the invention.

The microwave antenna preferably includes a slotted wall opposite the narrow wall and a polarisation grid disposed adjacent the slotted wall externally of the waveguide.

A radar antenna including a transition according to the present invention will now be described, by way of example, with reference to the accompanying drawings, where like features in different drawing figures are designated by like reference numbers and may not be described in detail for all drawings in which they appear.

DETAILED DESCRIPTION OF THE PREFERRED EMBODIMENTS

Figure 1:
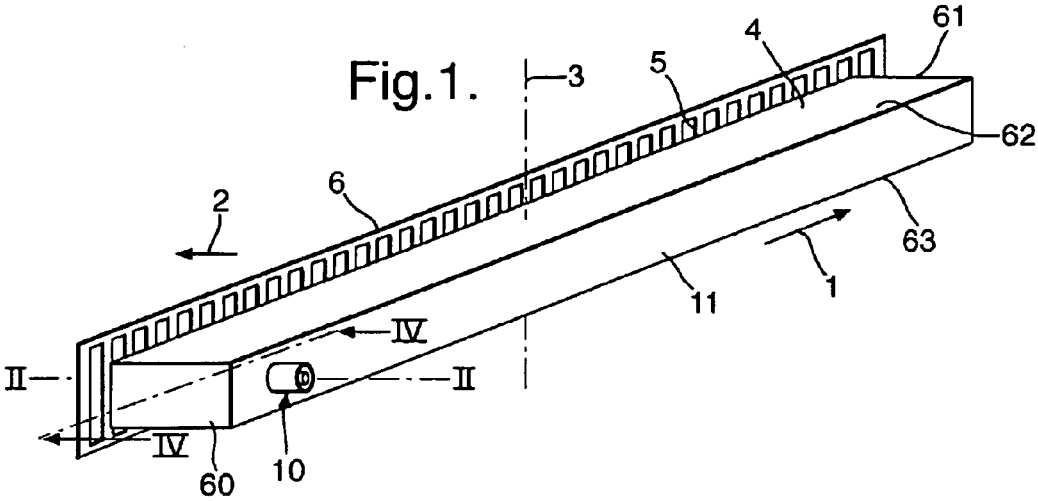
FIG. 1 is a perspective view from one end to the rear of the antenna.

With reference first to FIG. 1 there is shown a marine radar antenna, similar to that described in EP1313167, extending in a horizontal direction 1 and arranged to direct a beam of radiation in a second horizontal direction 2, which is near orthogonal to the first horizontal direction. The antenna is supported by a mount (not shown) for rotation about a vertical axis 3 so that the radiation beam is swept in azimuth.

The antenna includes a waveguide 4 extending across the width of the antenna at its rear side. The waveguide 4 is of hollow metal construction and rectangular section. The waveguide 4 is terminated at one end by a short circuit wall 60 and at its opposite end in a matched load 61. The forward-facing vertical face 5 of the waveguide 4 is slotted in the usual way so that energy is propagated from this face. This face 5 is spaced a short distance to the rear of a polarisation grid 6. Energy is supplied to and from the left-hand end of the waveguide 4 from a conventional source (not shown) via a transition, indicated generally by the number 10, having a coaxial transmission line input.

Figure 2:
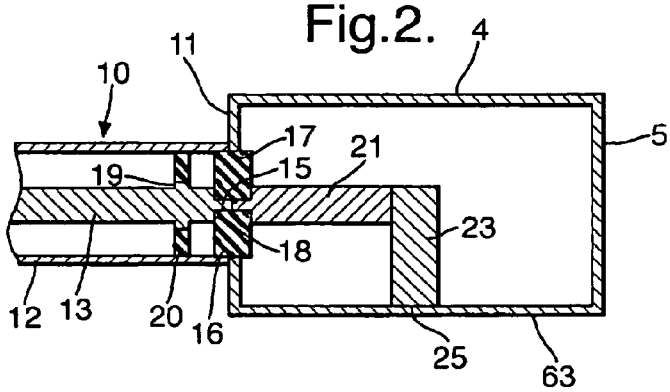
FIG. 2 is a cross-sectional view of the antenna along the line II—II in FIG. 1.

With reference now also to FIG. 2, the transition 10 is mounted on a vertical wall 11 at the rear of the waveguide 4. The wall 11 is narrow compared with the upper and lower faces or walls 62 and 63 in FIG. 1. The transition 10 includes, externally, a cylindrical metal outer conductor 12, attached on the narrow wall 11, and a rod-like metal first or inner conductor 13 extending axially within the outer conductor to form a coaxial transmission line. The spacing of the transition 10 from the short circuit 60 in FIG. 1 is determined by the operating frequency. At its inner end 15, the conductor 13 is supported by an annular dielectric bead 16 fitted in a circular hole 17 in the waveguide wall 11. The inner end 15 of the conductor 13 is reduced in diameter to form a step 18 to maintain the same impedance as the input transmission line. A matching section in the conductor 13 is provided by a flange-like enlarged section 19 spaced a short distance from the rear wall 11. This is surrounded by a second dielectric bead 20, which helps support the inner conductor 13 within the outer conductor 12. The matching sections 19 and 20 match out any remaining mismatches in the junction. There are various alternative arrangements by which the input coaxial connection can be matched, such as by tuning screws inserted through the outer conductor or a step in the outer conductor.

Figure 3:
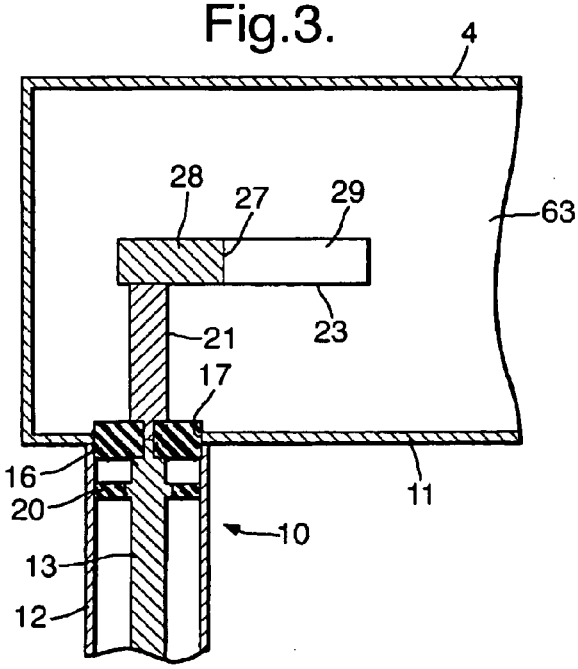
FIG. 3 is a plan view of the antenna at one end, including the transition.
Figure 4:
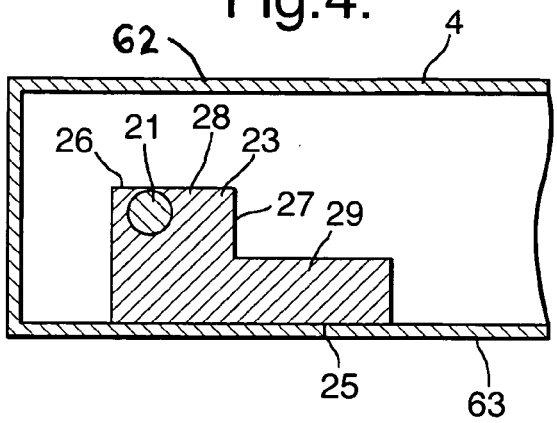
FIG. 4 is a cross-sectional elevation view looking forwardly along the line IV—IV in FIG. 1.

The forward end of the inner conductor 13 is electrically connected with a second, rod-like conductor 21 in an axial configuration. The rear end of the second conductor 21 is stepped so that the dielectric bead 16 is trapped between the two conductors. The second conductor 21 extends forwardly across the waveguide 4 midway up its height and is electrically connected at its forward end with a transition plate or vane 23. The plate 23 is of L shape and extends transversely, at right angles to the conductor 21. The thickness of the plate 23 is similar to the diameter of the conductor 21. The lower edge 25 (FIG. 2) of the plate 23 is flat and is in electrical contact with the inner surface of the lower wall 63 of the waveguide 4, extending lengthwise of the waveguide to the right, centrally across its width. As shown in FIG. 4, the upper edge 26 of the plate 23 has a step 27 dividing the plate into two sections 28 and 29 of different heights. The smaller height section 29 is located away from the junction with the conductor 21 and provides a quarter wave section. The plate 23, therefore, acts as a transition of the coaxial input with the narrow wall 11 of the waveguide 4, as illustrated in FIG. 3. This arrangement has been found to produce a very efficient transition with a wide bandwidth, typically giving a 6% bandwidth for a VSWR of better than 1.05 and an 11% bandwidth for a VSWR of better than 1.2.

Figure 5:
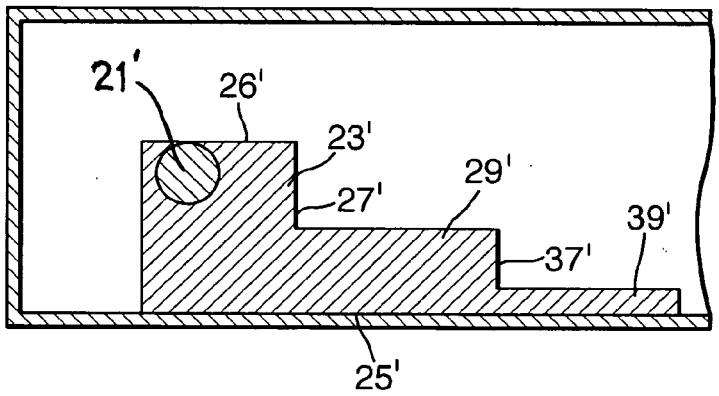
FIGS. 5 and 6 are cross-sectional elevation views showing two alternative transition plates.
Figure 6:
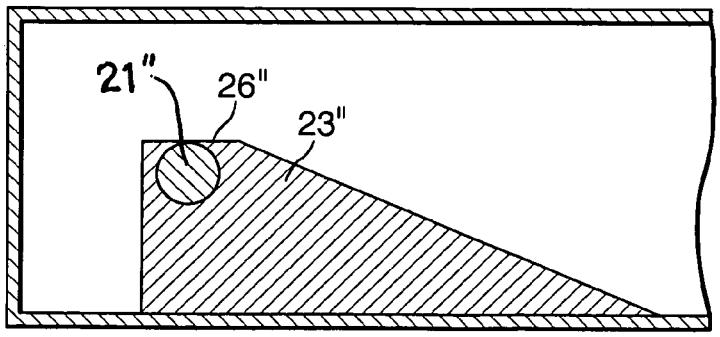

Various alternative forms of transition plate are possible, as shown in FIGS. 5 and 6. FIG. 5 shows a condutor 21' connects to a transition plate 23' with an upper edge 26' and having two steps 27' and 37' forming two quarter wave sections 29' and 39'. FIG. 6 shows a transition plate 23" with an upper edge 26" that tapers down along its length from a location just to the right of the junction with the conductor rod 21".

Figure 7:
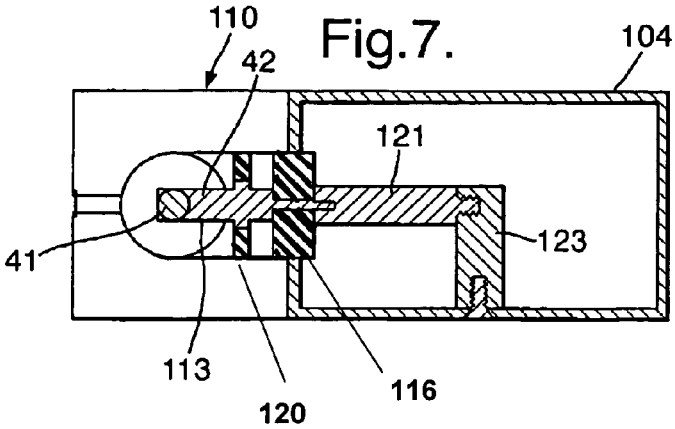
FIG. 7 is an end view of an alternative transition.
Figure 8:
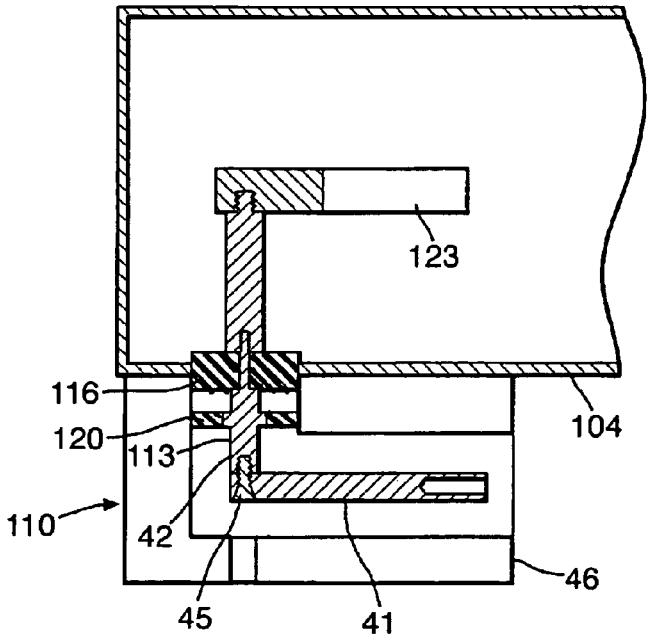
FIG. 8 is plan view of the alternative transition.
Figure 9:
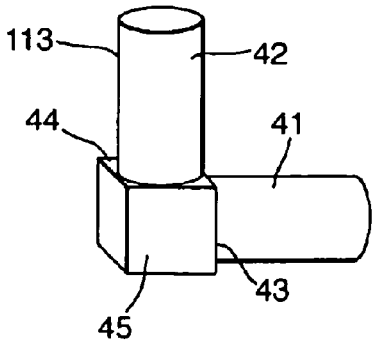
FIG. 9 is a perspective view of a right-angle conductor of the alternative transition.

With reference now to FIG. 7 an alternative transition 110 is shown where the coaxial connection extends parallel to the length of the waveguide 104. Equivalent components to those in the arrangement shown in FIGS. 1 to 4 are given a reference number which is determined by adding "100" to the corresponding reference number in FIGS. 1–4. For example, FIGS. 7 and 8 show transition plate 123 and annular dielectric beads 116 and 120, which correspond, respectively, to transition plate 23 and annular dielectric beads 16 and 20 in FIG. 2. The inner conductor 113 of the coaxial input has a 90° bend and is formed by the combination of two cylindrical conductors 41 and 42 joined with adjacent faces 43 and 44 of a metal cube 45, shown in FIG. 9. The face 46 of the transition 110 and the inner conductor 41 in FIG. 8 are configured to provide an interface to a standard ⅞" EIA connector. In other respects, the construction of the transition 110 is the same as in the arrangement of FIGS. 1 to 4. This transition 110 has the advantage that the input connector and its associated cable extends parallel to the waveguide, thereby allowing for a particularly compact configuration.

What I claim is:

1. A microwave transition comprising:

a waveguide of rectangular section, said waveguide having two narrow walls and two broad walls;

a radiating face provided by a first of said two narrow walls;

a first conductor extending through a second of said two narrow walls; and a transition plate attached with said first conductor within said waveguide, wherein said transition plate is aligned centrally between said two broad wall of said waveguide and extends lengthwise in contact with an internal surface of one of said two broad walls parallel to said radiating face, and wherein the height of said transition plate is greater adjacent said first conductor than away from said first conductor.

2. A microwave transition according to claim 1, wherein said transition plate is stepped to a reduced height away from said first conductor.

3. A microwave transition according to claim 2, wherein said transition plate provides a quarter wave section.

4. A microwave transition according to claim 1, wherein said transition plate tapers to a reduced height away from said first conductor.

5. A microwave transition according to claim 1, wherein a cylindrical outer conductor extends around a part of the length of said first conductor.

6. A microwave transition according to claim 5, including a dielectric member located between said first conductor and said outer conductor.

7. A microwave transition according to claim 1, wherein said first conductor comprises two axially aligned parts, and wherein a dielectric material is supported between said two parts of said first conductor in a hole in said narrow wall.

8. A microwave transition according to claim 1, wherein said first conductor has a portion extending parallel to one of said two narrow walls.

9. A microwave transition comprising:

a waveguide of rectangular section, said waveguide having two narrow walls and two broad walls;

a radiating face provided by a first of said two narrow walls;

a first conductor extending through a second of said two narrow walls; and a transition plate attached with said first conductor within said waveguide, wherein said transition plate has a flat edge and a stepped edge opposite said flat edge, wherein said plate is aligned centrally between said two broad wall of said waveguide and extends lengthwise with said flat edge in contact with an internal surface of one of said two broad walls parallel to said radiating face, and wherein the height of said transition plate steps down away from said first conductor.

10. A microwave transition comprising:

a waveguide of rectangular section, said waveguide having two narrow walls and two broad walls;

a radiating face provided by a first of said two narrow walls;

a first conductor extending through a second of said two narrow walls and having a right-angle bend externally of the waveguide such that a free end of the first conductor extends parallel with said two narrow walls; and a transition plate attached with said first conductor within said waveguide, wherein said transition plate is aligned centrally between said two broad wall of said waveguide and extends lengthwise in contact with an internal surface of one of said two broad walls parallel to said radiating face, and wherein the height of said transition plate is greater adjacent said first conductor than away from said first conductor.

11. A microwave antenna including a transition comprising:

a waveguide of rectangular section, said waveguide having two narrow walls and two broad walls;

a radiating face provided by a first of said two narrow walls;

a first conductor extending through a second of said two narrow walls; and a transition plate attached with said first conductor within said waveguide, wherein said transition plate is aligned centrally between said two broad wall of said waveguide and extends lengthwise in contact with an internal surface of one of said two broad walls parallel to said radiating face, and wherein the height of said transition plate is greater adjacent said first conductor than away from said first conductor.

12. A microwave antenna according to claim 11 including a slotted wall disposed in said radiating face and a polarization grid disposed adjacent said slotted wall externally of said waveguide.

* * * * *